United States Patent [19]

Ichimura

[11] 4,088,382

[45] May 9, 1978

[54] CONNECTING STRUCTURE OF TERMINALS

[75] Inventor: Yoshiaki Ichimura, Tokyo, Japan

[73] Assignee: Japan Aviation Electronics Industry, Ltd., Tokyo, Japan

[21] Appl. No.: 746,337

[22] Filed: Dec. 1, 1976

[51] Int. Cl.[2] ..... H01R 13/38
[52] U.S. Cl. ..... 339/99 R
[58] Field of Search ..... 339/97–99

[56] References Cited

U.S. PATENT DOCUMENTS 3,805,214 4/1974 Demler, Sr. et al. ..... 339/97 R
3,820,055 6/1974 Huffnagle et al. ..... 339/97 P

FOREIGN PATENT DOCUMENTS 1,640,630 10/1969 Germany ..... 339/97 R

*Primary Examiner*—Joseph H. McGlynn
*Attorney, Agent, or Firm*—Koda and Androlia

[57] ABSTRACT

Discloses a connecting structure of an electric terminal for connecting an insulated wire or coated conductor to the terminal. The connecting structure comprises a base, a pair of opposed forked portions continuously extending from the base and a center contact blade situated in between the forked portions, and by forcibly inserting the coated conductor into channels or notches in the forked portions, the coating of the coated wire is partially slitted and split along the wire or core conductor to expose it, then the exposed portion of the core conductor is positibly held in between the forked portions and the center contact blade.

11 Claims, 14 Drawing Figures

CONNECTING STRUCTURE OF TERMINALS

BACKGROUND OF THE INVENTION

This invention relates to an arrangement of the connecting section of a miniature electric terminal and it particularly relates to a connecting structure of an electric terminal for connecting a coated conductor or insulated wire to the terminal.

Generally, when a coated conductor is electrically connected to a terminal, the coating of a part of the coated conductor at which it is to be connected is removed to expose the core conductor or wire thereof and the exposed core conductor is connected to a connectiong section of the terminal by means of either soldering, pressing or lapping without using solder. In such conventional connecting means, since the coating of the coated conductor should be partially removed to expose the core conductor, the work is very difficult and delicate, thus sometimes, the core conductor has been subjected to damages and expensive special tools have been required for the work.

OBJECTS OF THE INVENTION

The primary object of the present invention is to provide a connecting structure of a miniature electric terminal, which structure is capable of mechanically and electrically connecting a coated conductor thereto by a simple operation.

Another object of the present invention is to provide a simple connecting structure of a miniature electric terminal, which can be manufactured at a low cost.

Another object of the present invention is to provide a connecting structure of a miniature electric terminal which enables to connect the core of a coated conductor thereto without requiring the step of pre-removing the coating of the coated conductor or wire.

Another object of the present invention is to provide a connecting structure of an electric terminal, which enables to remove the coating of coated conductor or wire without damaging the core conductor thereof and to connect the core conductor or wire to the terminal.

A further object of the present invention is to provide a miniature electric onnector which is capable of accurately removing a part of the coating of a coated conductor and positively connecting the core conductor thereof to a terminal.

It is further object of the present invention to provide a novel connector for ribbon cable containing a plurality of wires.

OUTLINE OF DRAWINGS

The above and other objects and features of the invention will more fully appear from the following detailed description when the same is read in connection with the accompanying drawings, in which.

DESCRIPTION OF THE INVENTION

Figure 3:
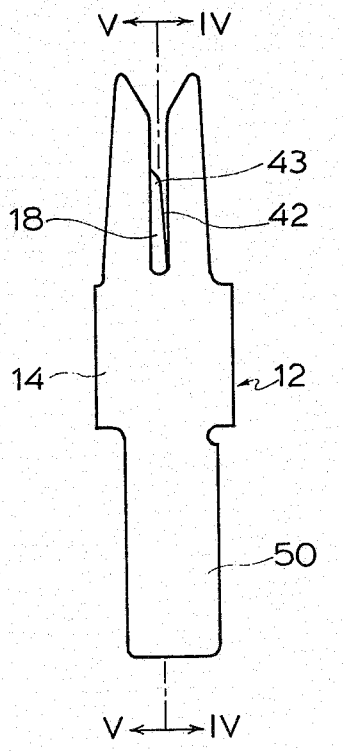
FIG. 3 is a front view of a terminal having a connecting structure of the present invention.
Figure 2:
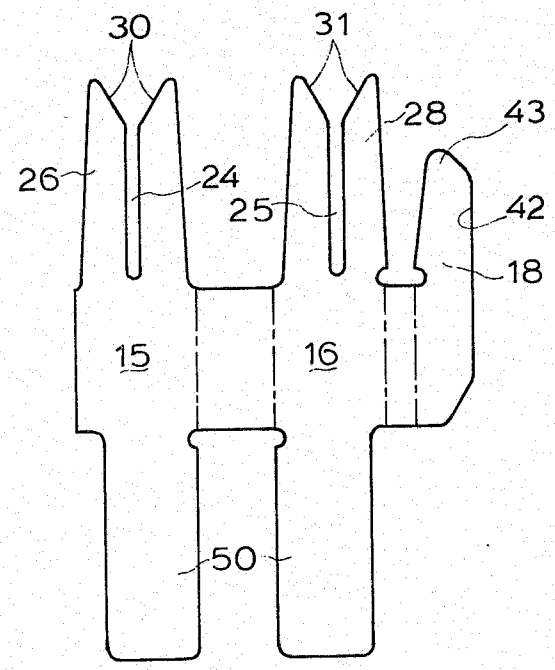
FIG. 2 is a development of sheet metal forming the terminal shown in FIG. 1.
Figure 1:
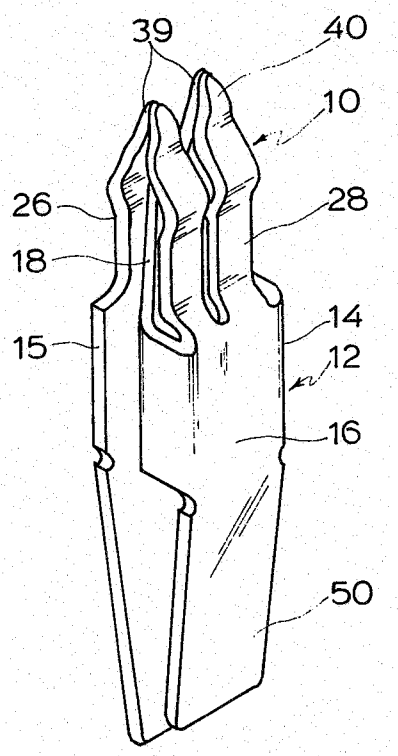
FIG. 1 is a perspective view of a terminal having a connecting structure of the present invention.

Referring now to the accompanying drawings, numeral 10 is a connecting structure according to the invention. A terminal 12 having the connecting structure 10 may be formed from a single piece of sheet metal shaped as shown in FIG. 2. The terminal 12 has a base 14 of three sided channel shape comprising a pair of opposed side flanges 15 and 16 and a center contact blade 18.

Figure 4:
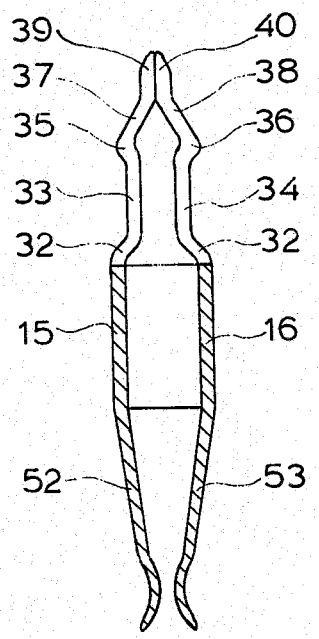
FIG. 4 is a sectional view taken in the direction of the arrows substantially along line IV—IV of FIG. 3.
Figure 5:
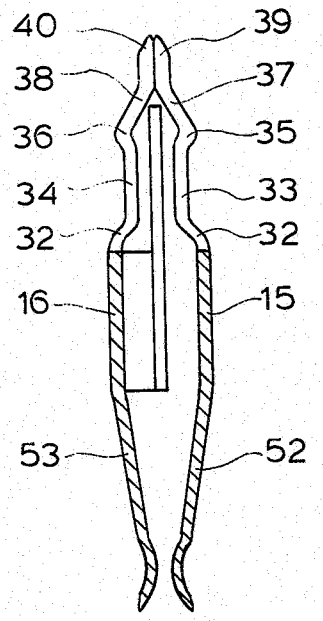
FIG. 5 is a sectional view taken in the direction of the arrows substantially along line V—V of FIG. 3.

In order to provide a connecting structure 10 for connecting a coated conductor or insulated wire 1 (FIG. 6) at the front end of the base 14, the base 14 has extensions of the side flanges 15 and 16 and narrow channels or notches 24 and 25 of which width at least substantially equals to the diameter of the core conductor or wire W of the coated conductor 1 so as to form forked portions 26 and 28. The forward edges of the forked portions 26 and 28 have mutually divergent portions 30 and 31. Referring to FIGS. 4 and 5, the forked portions are inwardly bent respectively at their root portions 32 adjacent to the side flanges 15 and 16, and the root portions 32 are extended so as to provide parallel extensions 32 and 34 which merge with outwardly bent portions 35 and 36 respectively. The forked portions 26 and 28 are respectively formed with inwardly inclined portions 37 and 38 extended from the outwardly bent portions 35 and 36 and the forward ends 39 and 40 of the inwardly inclined portions 37 and 38 are contacted with each other.

As shown in FIGS. 1, 3, 5 and 6, the center contact blade 18 is bent so that it is situated at the center between the side flanges 15 and 16 and that the inner edge 42 of the blade 18 lies adjacent to the longitudinal center line of the notches 24 and 25 in the forked portions 26 and 28. The forward end 43 of the blade 18 is terminated in a position where it is received in a space between wedge-like or V-shaped arms formed by inwardly inclined portions 37 and 38 of the forked portions 26 and 28.

The end of the base 14 of the terminal 12 on the opposite side of the connecting structure 10 may be formed in any suitable shapes according to its applications, such as, for example, resilient fingers 52 and 53 (FIGS. 4–6) which serve to lock with a pin-conductor.

Figure 6:
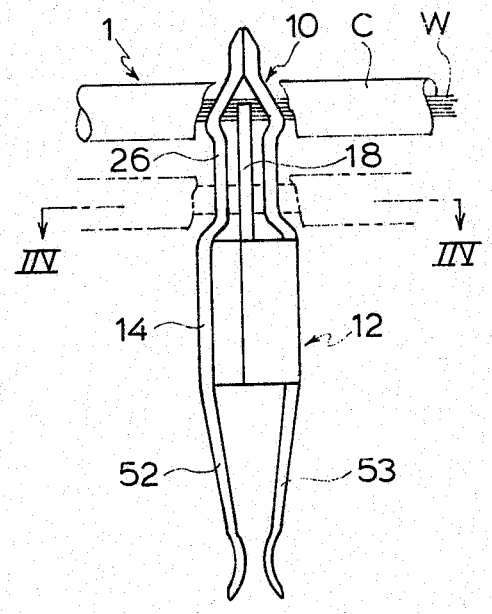
FIG. 6 is a side view showing a case of conncting a coated conductor to a terminal having a connecting structure of the present invention.
Figure 7:
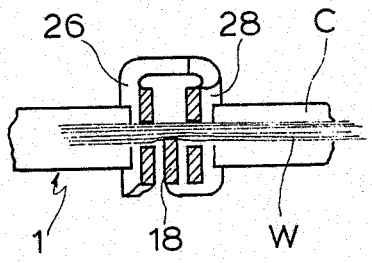
FIG. 7 is a sectional view taken on line VII—VII of FIG. 6, showing the coated conductor completely connected to the connecting structure of the present invention.

Now the method for connecting coated conductor 1 to the connecting structure 10 of a terminal according to the present invention will be described in detail with reference to FIG. 6. This can be accomplished by simply inserting one end of the coated conductor or wire 1 to be connected into the notches 24 and 25 from the forward end of the connecting structure 10 through the divergent chamfered portions 30 and 31 of the forked portions 26 and 28. In such a case, since the coating C of the coated conductor 1 is forced into the notches 24 and 25 having a width substantially equivalent to the diameter of the core wire W, the coating C is first slitted, then it is split along the wire W by the wedge or inclined portions 37 and 38 of the forked portions 26 and 28 to expose the core wire W as in FIG. 6. By further forcing the coated conductor 1 into the notches 24 and 25, the exposed portion of the core conductor W is brought into contact with the edges of the forked portions 26 and 28 and due to the inner edge 42 of the center contact blade, it is positively caught in between the forked portions 26 and 28 and the center contact blade 18 as shown in FIG. 7, thus since the exposed portion of the core wire W contacts with the connecting structure 10 at least at three points, the conductor or wire W may be mechanically and electrically connected to the terminal 12 in a positive manner.

Figure 9:
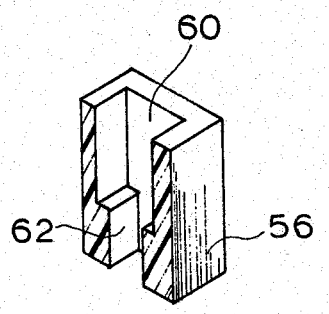
FIG. 9 is a sectional perspective view of a cover to be used with the receptacle shown in FIG. 8.
Figure 10:
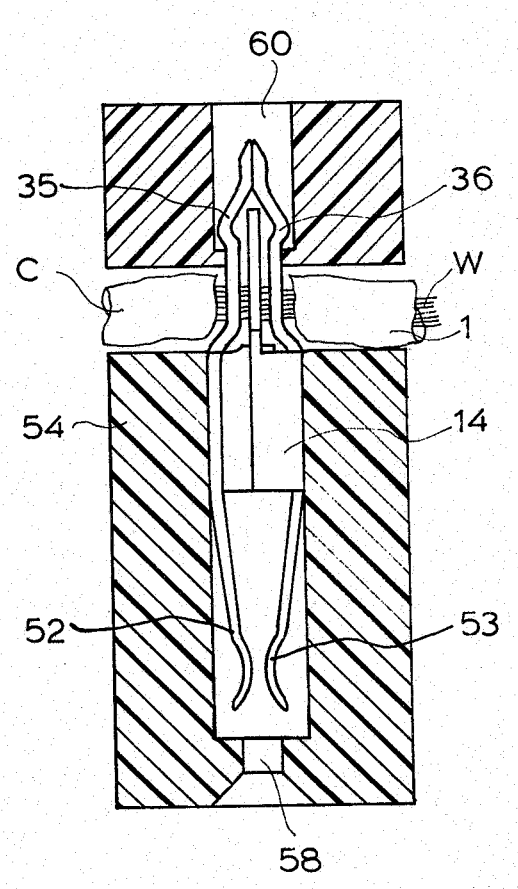
FIG. 10 is a sectional view showing the state of a coated conductor connected to the receptacle of FIG. 8 with the cover of FIG. 9.
Figure 8:
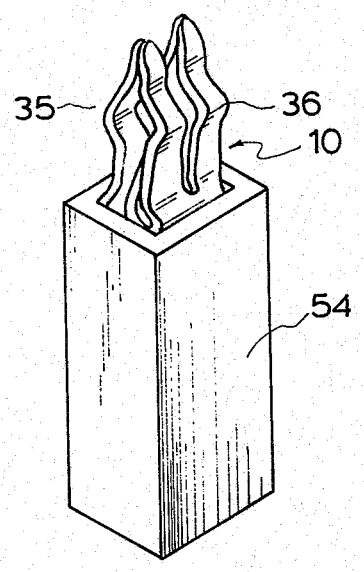
FIG. 8 is a sectional view showing a preferred embodiment of the present invention in which a receptacle of a connector is associated with a terminal having a connecting structure of the present invention.

Reference will now be made to FIGS. 8, 9 and 10 which show an embodiment of the present invention wherein the terminal 12 having a connecting structure 10 is mounted in a housing 54 of dielectric material, such as suitable plastic to use it as a receptacle of a connector.

In this embodiment, the connecting structure 10 of the terminal 12 is similar to that has been described hereinbefore, whereas in the opposite end of the terminal 12 the side flanges 15 and 16 are continuously extended from the base 14 to provide resilient fingers 52 and 53 which are capable of resiliently clamping a pin-connector (not shown) to be received therebetween so as to serve as a junction which associates with the pin-conductor.

The dielectric housing 54 of the receptacle allows to project the connecting structure 10 of the terminal 12 from its one end, fixedly secures the base 14 of the terminal and may be cooperated with a dielectric cover 56 which serves in association with the connecting structure 10 to insert the coated wire 1 and to prevent escape of the coated wire 1 from the connecting structure 10. The other end of the housing 54 is provided with an opening 58 into which the pin-conductor is pluged.

The dielectric cover 56 has a recess or opening 60 passing therethrough. The opening 60 in the cover 56 receives the connecting structure 10 projected from the housing 54 and as clearly shown in FIGS. 9 and 10, the opening 60 is provided with a shoulder 62 on its inner wall portion facing to the outwardly bent portions 35 and 36 of the connecting structure 10 at the end of the opening 60 facing to the housing 54, thus when the connecting structure 10 is inserted into the opening 60, the shoulder 62 presses the wedge or outwardly bent portions 35 and 36 so as to allow them passing therethrough, then the outwardly bent portions 35 and 36 restore to their original state in the enlarged portion of the opening 60 whereby the cover 56 is firmly secured to the connecting structure 10.

In this embodiment, when the coated conductor or insulated wire 1 is placed on the divergent chamfered portions 30 and 31 of the forked portions 26 and 28 of the connecting structure 10 in the same manner described hereinbefore, and the cover 56 is pushed down as shown in FIG. 10, the coating C of the coated conductor 1 is slitted and split to expose the wire W of the coated conductor and to connect the wire W to the connecting structure 10, while the cover 56 positively prevents the coated conductor 1 from escaping.

Figure 11:
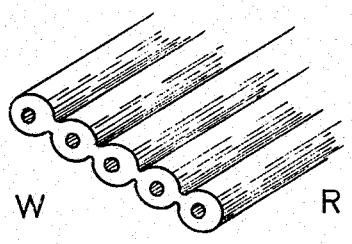
FIG. 11 is a perspective view of ribbon cable.

The connecting structure of the present invention may also be applied to and used as a connector for a ribbon cable R of the type comprising a plurality of coated conductors arranged and bonded to each other in band shape as shown in FIG. 11.

Figure 13:
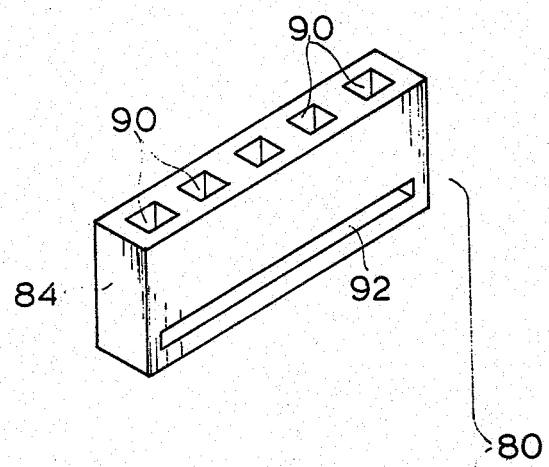
FIG. 13 is a perspective view of a cover to be used for the connector of FIG. 12.
Figure 12:
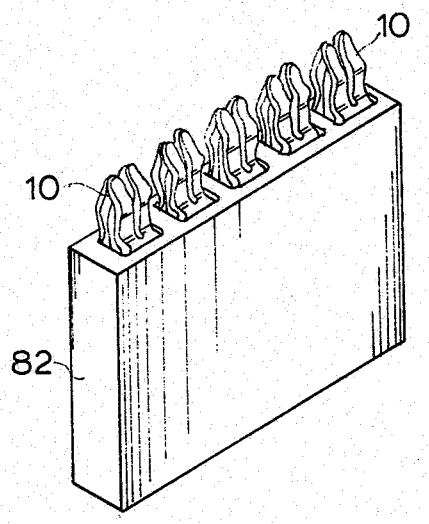
FIG. 12 is a perspective view showing an embodiment of the present invention in which a plurality of connecting structures are used as connectors for ribbon cable.
Figure 14:
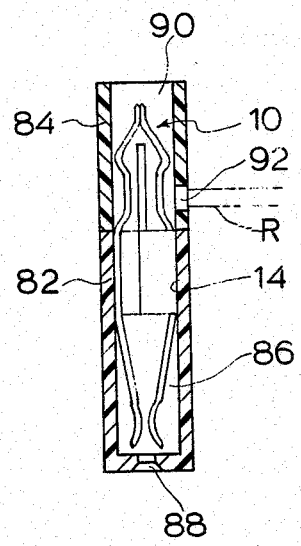
FIG. 14 is a sectional view of the connector and the cover shown in FIGS. 12 and 13.

As shown in FIGS. 12 and 13, the connector 80 for the ribbon cable R includes a supporting housing 82 and a cover 84 formed of a dielectric material. The housing 82 is an elongated integral structure having recesses 86 for mounting a number of terminals 12 respectively provided with the connecting structures of the present invention at intervals equivalent to that of core wires W of the ribbon cable R, each terminal 12 is supported by the recess 86 at its base 14 and its connecting structure 10 is projected outwardly from one end of the housing 82. The other end of the housing has a series of openings 88 for plug-in connection with pin-conductors to be contacted with the terminals 12.

The dielectric cover 84 has a series of openings 90 to receive the connecting structures 10 of the terminals 12 and to associate therewith respectively. Each opening 90 may be provided with a shoulder, for example, corresponding to the shoulder 62 in the opening 60 of the embodiment described with reference to FIG. 10. The cover 84 is provided, at least in its one side, with an elongated opening 92 for receiving the end of the ribbon cable R to be connected.

In this embodiment, when the end of the ribbon cable R to be connected to the connector 80 is inserted into the elongated opening 92 in the dielectric cover 84 and the cover 84 is placed on the dielectric housing 82 in which the terminals have been mounted so as to project their connecting structures 10, then a suitable pressure is applied to the cover 84, the connecting structures of the terminals 12 may be respectively connected to the core wires W of the ribbon cable R, as evidient from the foregoing description.

While there has been particularly shown and described with reference to preferred embodiments thereof, it will be understood by those skilled in the art that the foregoing and other changes in form and details can be made therein without departing from the spirit and scope of the invention.

What is claimed is:

1. A connecting structure of an electric terminal for connecting a coated wire, which structure comprising:

a base, a pair of opposed forked members continuously extending from one end of said base and respectively having longitudinal channels at the center thereof, said pair of forked members further each having first portions for slitting only the coating of the coated wire at one place as it is inserted into the channels of said pair of forked members, second portions for exposing the core wire of said coated wire by splitting the coating along the single slit, said second portions of each of said pair of forked members touching at the ends thereof and forming a generally wedge shape therein between, and third portions for holding the exposed core wire of the coated wire, and a center contact blade extending between said pair of forked members, said center contact blade cooperating with third portions of said forked members to hold said exposed core wire and making electrical contact with said exposed core wire.

2. A connecting structure of an electric terminal as claimed in claim 1, wherein the channels of said forked portions have a width substantially equivalent to the diameter of the coated wire to be connected to the terminal.

3. A connecting structure of an electric terminal as claimed in claim 1, wherein the inner edge of said center contact blade is positioned adjacent to the longitudinal center line of said channels.

4. A connecting structure of an electric terminal as claimed in claim 1, wherein the forward ends of the channels of said forked portions are in divergent form.

5. A connecting structure of an electric terminal as claimed in claim 1, wherein said forked portions and said center contact blade hold the exposed core wire therebetween at least at three points.

6. A connecting structure of an electric terminal as claimed in claim 1, wherein the other end of said base is formed with resilient fingers for receiving a pin-conductor.

7. An electric connector according to claim 1 further comprising a dielectric housing for said electric terminal and a dielectric cover for inserting coated wire to be connected into said terminal in association with said connecting structure.

8. An electric connector as claimed in claim 7, wherein said dielectric cover has an opening to be fitted on said connecting structure, said opening being provided with a shoulder at its end facing to the dielectric housing to engage with the wedge-shaped portions of said connecting structure.

9. A connecting structure of an electric terminal according to claim 1 further comprising a dielctric housing having one end through which said connecting structure of said terminal projects outwardly while fixedly securing the structure at its base.

10. An electric connector according to claim 9 further comprising a dielectric cover having a plurality of openings for inserting a ribbon cable to be connected to said terminals in association with said connecting structure of said terminals.

11. An electric connector as claimed in claim 10, wherein said dielectric cover has an elongated opening in at least one side wall for inserting the end of the ribbon cable.

* * * * *